US006672917B2

(12) United States Patent
Matsuda et al.

(10) Patent No.: US 6,672,917 B2
(45) Date of Patent: Jan. 6, 2004

(54) PROCESS FOR IMPROVING AN ANODIZING FILM, AN ANODIZING FILM STRUCTURE AND AN ALUMINUM-ALLOY-MADE OUTBOARD ENGINE

(75) Inventors: Yoshiyuki Matsuda, Wako (JP); Hiroyuki Murata, Wako (JP); Norimasa Takasaki, Wako (JP); Morihiro Takemura, Hamamatsu (JP)

(73) Assignees: Honda Giken Kogyo Kabushiki Kaisha, Tokyo (JP); Yutaka Giken Co., Ltd., Shizuoka (JP)

( * ) Notice: Subject to any disclaimer, the term of this patent is extended or adjusted under 35 U.S.C. 154(b) by 0 days.

(21) Appl. No.: 10/090,062

(22) Filed: Mar. 1, 2002

(65) Prior Publication Data

US 2002/0164909 A1 Nov. 7, 2002

(30) Foreign Application Priority Data

Mar. 2, 2001 (JP) ..... 2001-057868

(51) Int. Cl.[7] ..... B63H 20/32

(52) U.S. Cl. ..... 440/76; 148/247; 148/253; 440/77; 440/78; 440/113

(58) Field of Search ..... 440/113, 900, 440/76, 77, 78; 428/472.3; 148/247, 253

(56) References Cited

U.S. PATENT DOCUMENTS

| | | | | | |
|---|---|---|---|---|---|
| 4,148,670 | A | * | 4/1979 | Kelly | 148/247 |
| 4,436,772 | A | * | 3/1984 | Yamabe et al. | 427/379 |
| 5,139,449 | A | * | 8/1992 | Akahori | 440/76 |
| 5,756,218 | A | * | 5/1998 | Buchheit et al. | 428/469 |
| 6,312,821 | B1 | * | 11/2001 | Takasaki et al. | 428/472.3 |
| 6,410,144 | B2 | * | 6/2002 | Dearnaley et al. | 428/408 |

FOREIGN PATENT DOCUMENTS

JP 02250997 10/1990

* cited by examiner

*Primary Examiner*—Sherman Basinger
(74) *Attorney, Agent, or Firm*—Adams & Wilks

(57) ABSTRACT

A process for forming an improved anodizing film on the surface of an aluminum alloy material. The film is impregnated with an amorphous substance which fills pores formed in the film during its growth. If the film has a flaw reaching the aluminum alloy material, the amorphous substance and aluminum form a layer of passivity which restrains the corrosion of the aluminum alloy material.

21 Claims, 9 Drawing Sheets

PROCESS FOR IMPROVING AN ANODIZING FILM, AN ANODIZING FILM STRUCTURE AND AN ALUMINUM-ALLOY-MADE OUTBOARD ENGINE

FIELD OF THE INVENTION

This invention relates to the construction of an anodizing film which improves the corrosion resistance of an aluminum alloy product or part used in the presence of water, such as a boat propeller or hull used in a sea or lake, a water pump or sprayer driven by a general-purpose engine or an agricultural machine used in a paddy field.

BACKGROUND OF THE INVENTION

Every such product or part is usually covered with a rust- or corrosion-preventing surface coating. Of particular importance is a rust-proofing coating which enables any such product or part to stand seawater containing salt as an element accelerating corrosion. A large number of technical proposals have hither to been made about rust- or corrosion-preventing coating, and include Japanese Patent Laid-Open Publication No. HEI-2-250997 entitled "Method for Rust-Proofing Treatment of Aluminum Material and an Aluminum Outboard Engine", which is characterized by forming an anodizing film on the surface of an aluminum or aluminum alloy material, sealing its pores with molybdenum disulfide and forming a surface coating thereon.

The proposed aluminum outboard engine has, however, been found to exhibit only the corrosion resistance which was satisfactory as intended in those days, but which never satisfies the severe requirements of recent years.

SUMMARY OF THE INVENTION

This invention provides a rust-proofing structure of improved corrosion resistance.

We, the inventors of this invention, have paid attention to the proposed use of molybdenum disulfide and found a problem as a result of our study. More specifically, we have reached the conclusion that molybdenum disulfide is a crystalline substance which does not form any layer of passivity with aluminum, but merely closes the pores of an anodizing film and adheres to it, and is not satisfactory in durability. We have, therefore, studied the use of an amorphous substance capable of forming a layer of passivity with aluminum and succeeded in establishing technology which can overcome the problem of the prior art.

According to a first aspect of this invention, there is provided a process for improving an anodizing film which comprises the steps of forming an anodizing film on the surface of an aluminum alloy material, impregnating the film with an amorphous substance capable of forming a layer of passivity with aluminum to fill pores formed in the film during its growth, and sealing the pores to close their inlets to confine the amorphous substance therein.

The anodizing film is impregnated with an amorphous substance so that a layer of passivity may be formed between the amorphous substance and aluminum if the film should have any flaw reaching the aluminum alloy material. The formation of such a layer makes it possible to restrain corrosion.

According to a preferred example of this invention, zirconium phosphate is used as the amorphous substance. Zirconium phosphate or chromium chromate can be used as an amorphous substance forming a layer of passivity with aluminum, but chromium chromate is a harmful heavy metal and gives waste water incurring a high cost of disposal. Zirconium phosphate is preferred, since it does not require any such costly treatment, but enables a reduction of cost for an improved anodizing film. According to a preferred example, it is adequate to use zirconium phosphate in the amount of about 15 mg/cm$^2$ to 45 mg/cm$^2$.

Even boiling water or sodium silicate can be used for the sealing of the pores. The use of nickel acetate is, however, preferred for corrosion resistance to boiling water or sodium silicate.

The process may further include the step of coating the surface of the anodizing film with a primer after the sealing of its pores. The anodizing film and primer protect the aluminum alloy material if they are sound, while if the film is damaged, zirconium phosphate and aluminum form a layer of passivity which protects the aluminum alloy material. According to a preferred example, phosphomolybdic acid is used as a pigment for the primer. Zinc phosphate or tripolyphosphoric acid can also be used as the pigment. Phosphomolybdic acid is, however, preferred for corrosion resistance. According to a preferred example, it is adequate to use phosphomolybdic acid in the proportion of 5 to 15% by weight.

According to a second aspect of this invention, there is provided an anodizing film structure which comprises an anodizing film formed on the surface of an aluminum alloy material, zirconium phosphate impregnating the film to fill pores formed therein during its growth, and a seal closing the inlets of the pores.

According to the structure, the anodizing film is impregnated with an amorphous substance so that a layer of passivity may be formed between zirconium phosphate and aluminum if the film should have any flaw reaching the aluminum alloy material. The formation of such a layer makes it possible to restrain corrosion. The film having its pores sealed protects the aluminum alloy material if it is sound, while if it is damaged, zirconium phosphate and aluminum form a layer of passivity which protects the aluminum alloy material. The structure, therefore, provides a long time of protection for the aluminum alloy material. As regards the amount of zirconium phosphate as the impregnant, it is adequate to use about 15 mg/cm$^2$.

The structure may further include a primer layer formed on the surface of the anodizing film including the seal. The primer layer and the film having its pores sealed protect the aluminum alloy material if they are sound, while if the film is damaged, zirconium phosphate and aluminum form a layer of passivity which protects the aluminum alloy material. The structure, therefore, provides a still longer time of protection for the aluminum alloy material. The primer layer may be of a primer containing phosphomolybdic acid as a pigment. Zinc phosphate or tripoly-phosphoric acid can also be used as the pigment. Phosphomolybdic acid is, however, preferred for corrosion resistance.

According to a third aspect of this invention, there is provided an aluminum-alloy-made outboard engine which comprises an engine cover, an under cover attached to the bottom of the engine cover, an extension case attached to the bottom of the under cover and a gear case attached to the bottom of the extension case, each of at least the extension and gear cases having an anodizing film structure comprising an anodizing film formed on the surface of an aluminum alloy material, zirconium phosphate impregnating the film to fill pores formed therein during its growth, and a seal closing the inlets of the pores.

The outboard engine is exposed to salt water and sea breezes, and the gear and extension cases are, among others, exposed to seawater and attacked by chlorine ions in seawater, etc. The anodizing film covers the aluminum alloy material to prevent its corrosion by chlorine ions, and the pores of the film are filled with zirconium phosphate and closed at their inlets. The anodizing film structure gives the outboard engine a greatly improved corrosion resistance and protects it from corrosion.

BRIEF DESCRIPTION OF THE DRAWINGS

Several preferred embodiments of the invention will be described in detail below, by way of example only, with reference to the accompanying drawings, in which.

DETAILED DESCRIPTION OF THE PREFERRED EMBODIMENTS

Figure 1:
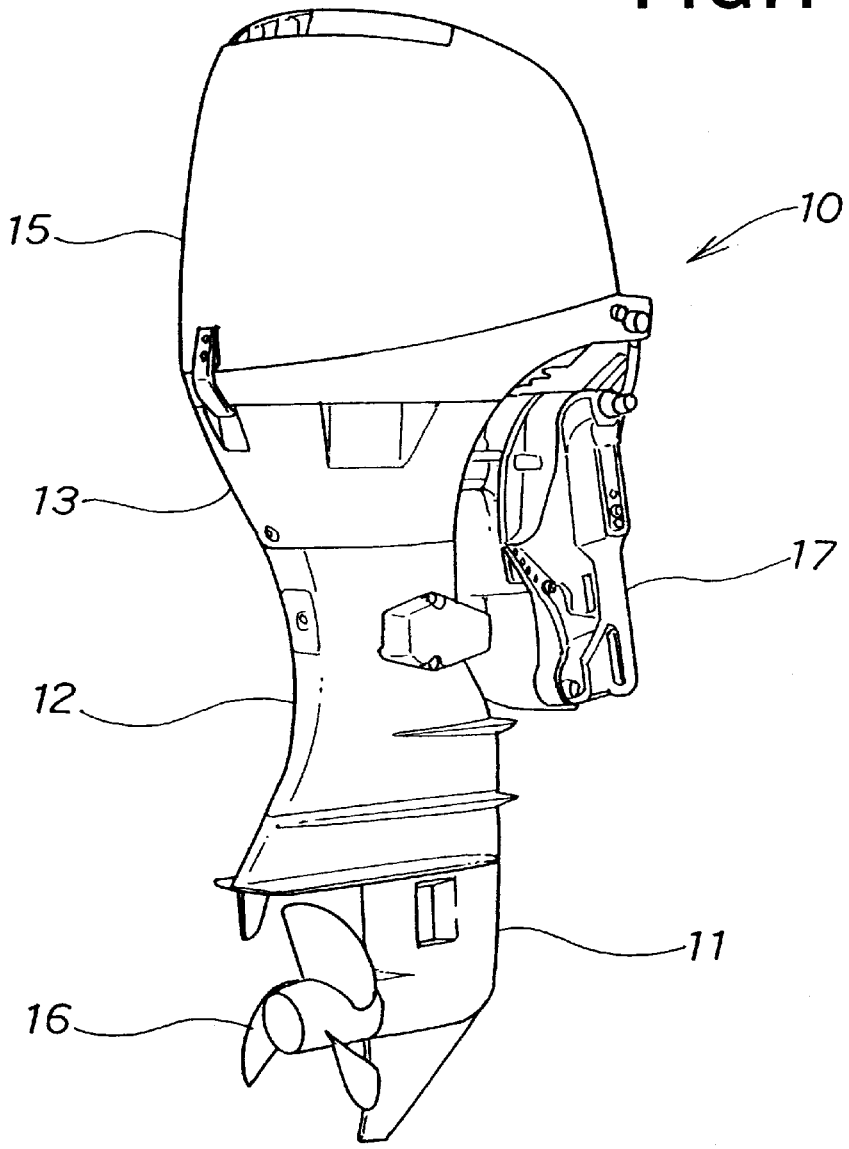
FIG. 1 is a perspective view of an aluminum-alloy-made outboard engine embodying this invention.

Referring first to FIG. 1, an outboard engine 10 embodying this invention has a gear case 11, an extension case 12, an under cover 13 and an engine cover 15. A screw 16 is driven by an engine, a vertical shaft and a gear set enclosed in the engine cover 15, though not shown. The outboard engine 10 is attached to the stern of a ship not shown by a stern bracket 17, and an anodizing film structure according to this invention is applied to, among others, the gear and extension cases 11 and 12 which are dipped in seawater. The structure is, of course, applicable to any other part, too.

The anodizing film structure of this invention is applicable to any aluminum alloy product or part used in the presence of water, such as a ship propeller or hull used in a sea or lake, a water pump or sprayer driven by a general-purpose engine or an agricultural machine used in a paddy field.

Figure 2A:
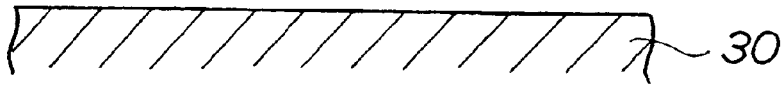
FIGS. 2A to 2F are schematic sectional views illustrating a process for forming an anodizing film structure embodying this invention.
Figure 2B:
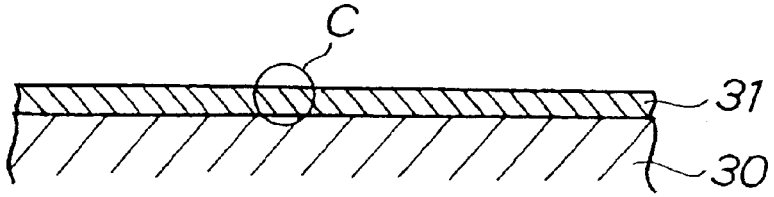
Figure 2C:
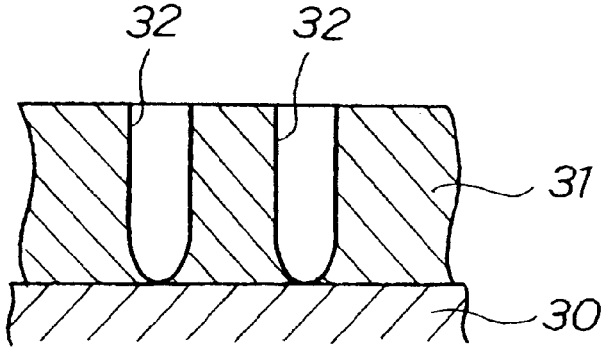

Description will now be made of a basic process for manufacturing an anodizing film structure according to this invention with reference to FIGS. 2A to 2F. FIG. 2A shows an aluminum alloy material 30. An anodizing film 31 having a thickness of about 15 microns is formed on the surface of the aluminum alloy material 30 by a known anodizing method, as shown in FIG. 2B. The anodizing film 31 is an oxide film consisting mainly of A1203 and fine pores 32 are unavoidably formed in the film during its growth from bottom to top, as shown in FIG. 2C showing an enlarged portion C of FIG. 2B.

Figure 2D:
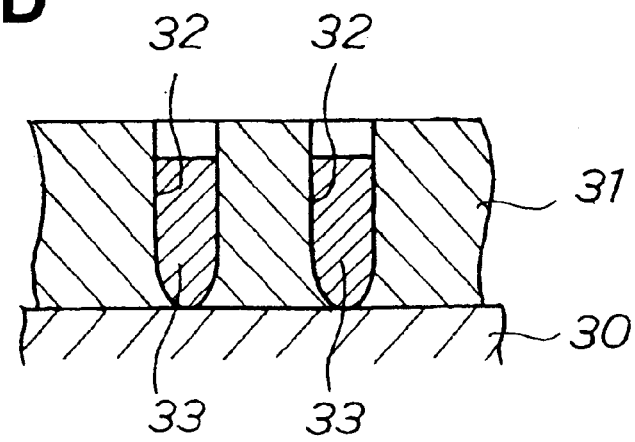
Figure 2E:
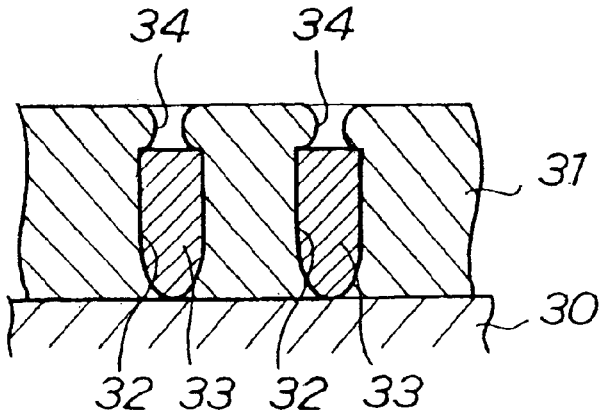

An amorphous substance 33 capable of forming a layer of passivity with aluminum is introduced into the pores 32, as shown in FIG. 2D. It would be more adequate to say that the film 31 is impregnated with the amorphous substance 33, insofar as the pores 32 are so small. The amorphous substance 33 may be zirconium phosphate or chromium chromate. FIG. 2E shows a sealing process in which the pores 32 are being closed at their inlets 34 by a known sealant. Nickel acetate (amorphous) or sodium silicate (crystalline) can, for example, be used as the sealant.

Figure 2F:
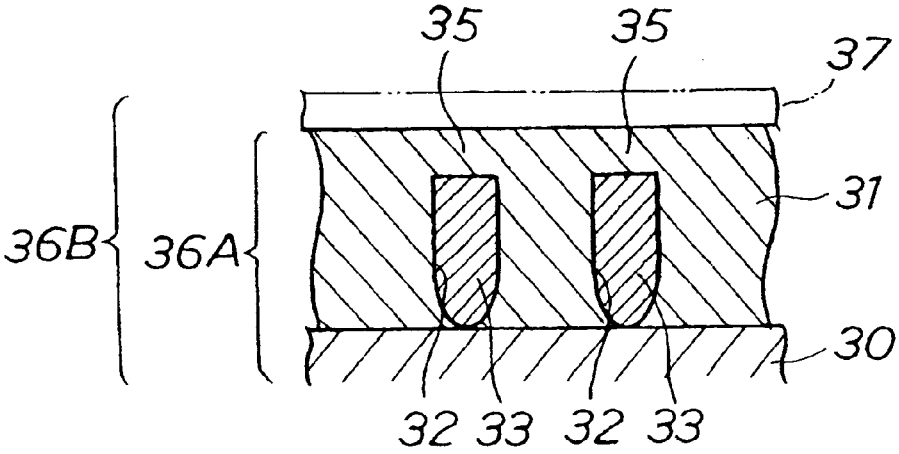

FIG. 2F shows two alternative forms of anodizing film structure as completed by the sealing process. One structure 36A comprises an anodizing film 31 formed on the surface of an aluminum alloy material 30, zirconium phosphate 33 impregnating the film 31 to fill its pores 32, and a seal 35 closing the inlets of the pores 32. The other structure 36B comprises an anodizing film 31 formed on the surface of an aluminum alloy material 30, zirconium phosphate 33 impregnating the film 31 to fill its pores 32, a seal 35 closing the inlets of the pores 32 and a primer layer 37 formed on the surface of the film 31 including the seal 35. The primer layer 37 is preferably of a primer containing an epoxy resin as a base and phosphomolybdic acid as a pigment.

Figure 3:
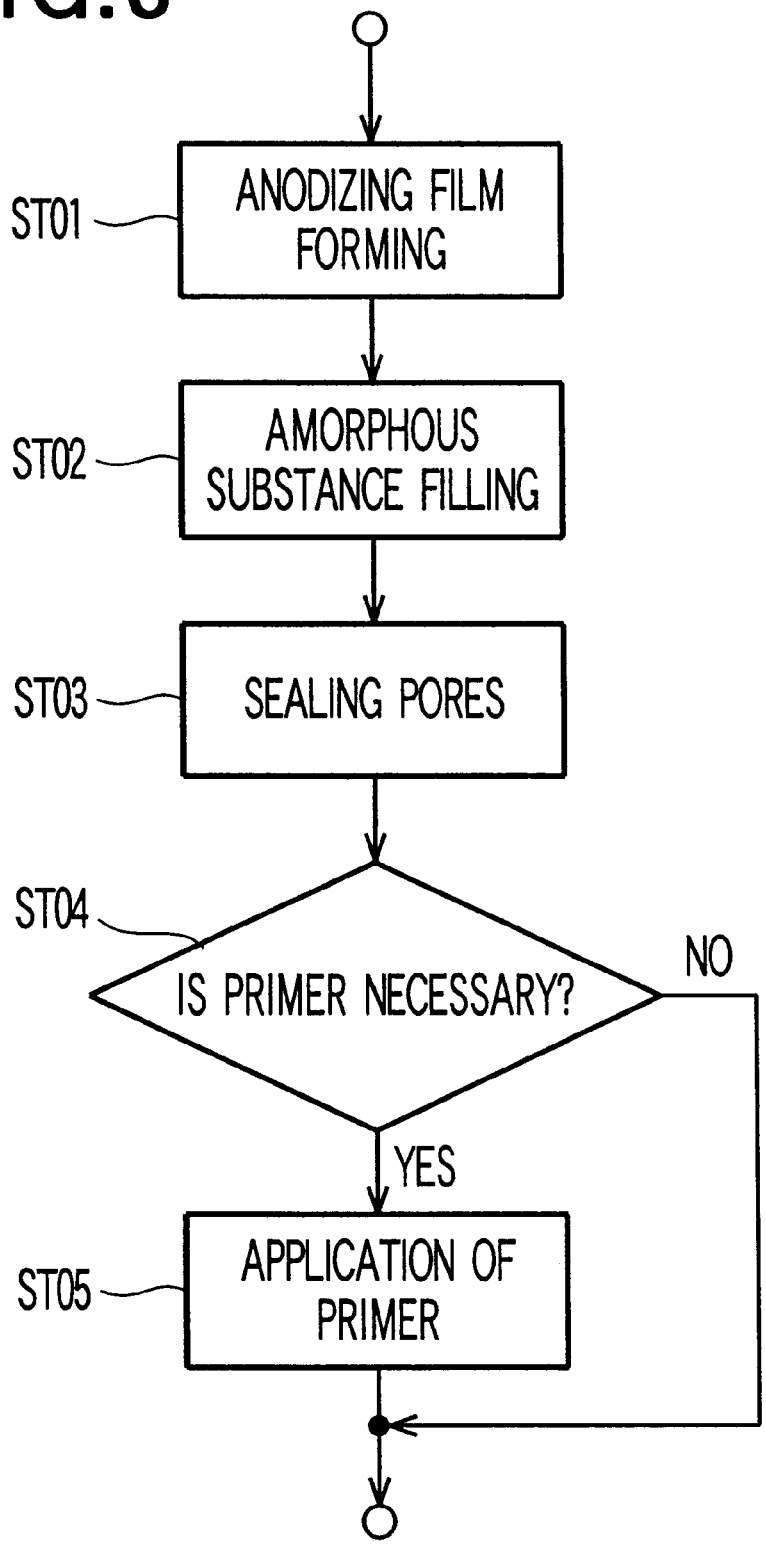
FIG. 3 is a flowchart showing a process embodying this invention for improving an anodizing film.

FIG. 3 is a flowchart showing a process embodying this invention for improving an anodizing film by the steps shown in FIGS. 2A to 2F.

Step 1 (ST01): An anodizing film is formed on the surface of an aluminum alloy material, as shown in FIG. 2B;

Step 2 (ST02): The pores formed in the film are filled with an amorphous substance, as shown in FIG. 2D;

Step 3 (ST03): The pores are sealed to have their inlets closed, as shown in FIGS. 2E and 2F;

Step 4 (ST04): If a primer is necessary, Step 5 (ST05) is followed, but if not, the process is finished;

Step 5 (ST05): A primer is applied to the surface of the film having its pores sealed.

The basic process of this invention consists of the steps of forming an anodizing film on the surface of an aluminum alloy material, impregnating the film with an amorphous substance capable of forming a layer of passivity with aluminum to fill pores formed in the film, and sealing the pores to close their inlets to confine the amorphous substance therein.

Figure 4A:
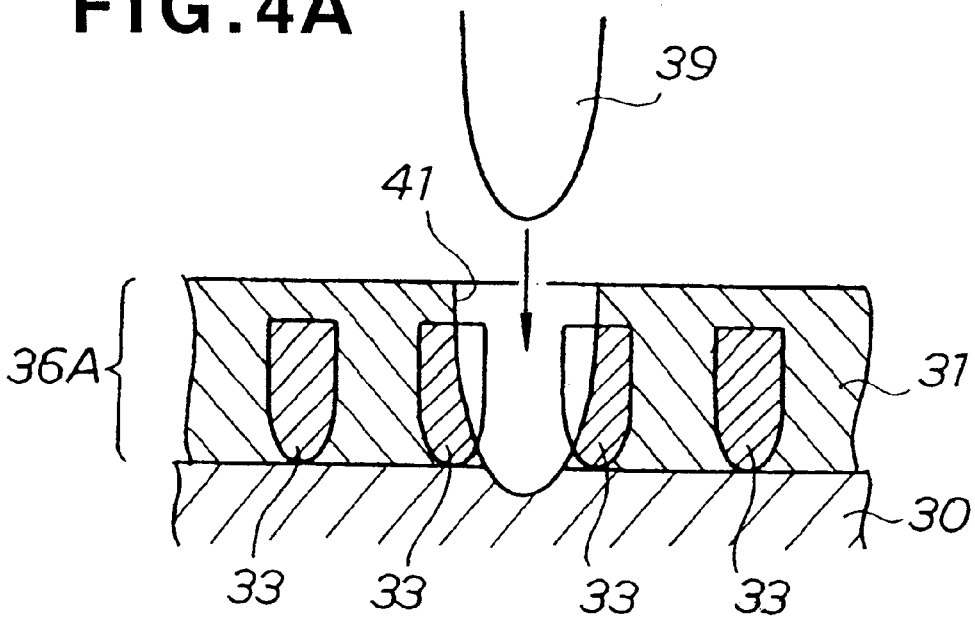
FIGS. 4A and 4B are schematic sectional views showing the result of a flaw made in an aluminum alloy material on which an anodizing film structure is formed as shown in FIG. 2F.
Figure 4B:
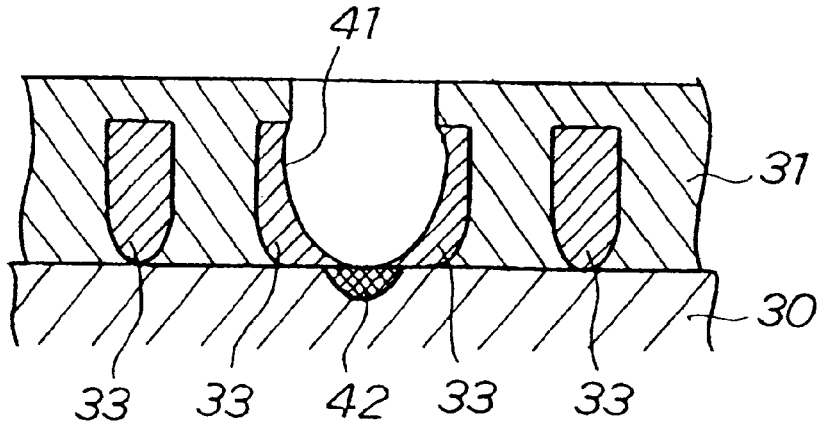

FIGS. 4A and 4B show the function of the anodizing film structure according to this invention. FIG. 4A shows a flaw 41 made in the anodizing film structure 36A by a sharp object 39 and reaching the aluminum alloy material 30. FIG. 4B shows a layer 42 of passivity formed by the amorphous substance 33 covering the exposed portion of the aluminum alloy material 30. The layer 42 protects the aluminum alloy material 30 from attack by chlorine ions in salt water.

The layer 42 of passivity is, of course, lower in corrosion resistance than the anodizing film structure 36A or 36B shown in FIG. 2F. It, however, provides corrosion resistance for emergency purposes if the structure 36A or 36B is locally destroyed. The destruction of an ordinary anodizing film results in corrosion. According to this invention, however, the layer 42 of passivity is formed in the anodizing film structure 36A or 36B to resist corrosion even if the anodizing film 31 may be destroyed.

Description will now be made of a variety of experimental examples embodying the invention. It is, however, to be understood that these examples are not intended for limiting the scope of this invention.

As this invention is concerned with a corrosion-resistant film or coating structure, its evaluation is mainly made for corrosion resistance by conducting a salt spray test as described below, and determining the width of a corroded area found after a specific length of time.

(1) Salt Spray Test

The salt spray test was conducted by employing a spray chamber, a solution of NaCl having a concentration of 5 plus or minus 0.5%, compressed air having a pressure of 68.6 to 177 kpa and a temperature controller for maintaining a temperature of 35 plus or minus 1 deg. C., and spraying salt water against each test specimen for a specific length of time at a relative humidity of 95 to 98% and a temperature of 35 plus or minus 1 deg. C. in accordance with the requirements of the Japanese Industrial Standard, JIS Z 2371—Method for a Salt Spray Test.

Figure 5A:
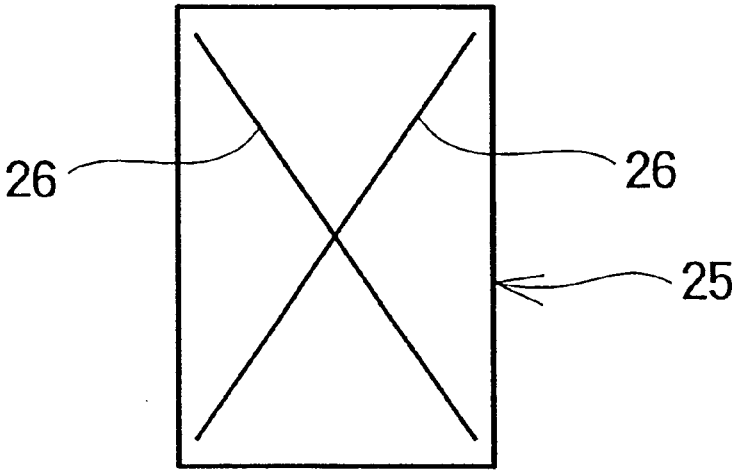
FIGS. 5A and 5B are views showing a test specimen having an X-shaped flaw made therein, and an area of corrosion as found along the flaw, respectively.

(2) Test Specimen (see FIG. 5A):

Each test specimen 25 was prepared by anodizing a piece of an aluminum alloy measuring 70 mm by 150 mm by 3.0 mm, applying a primer to it and cutting X-shaped lines 26 therein with a knife.

(3) Evaluation

Figure 5B:
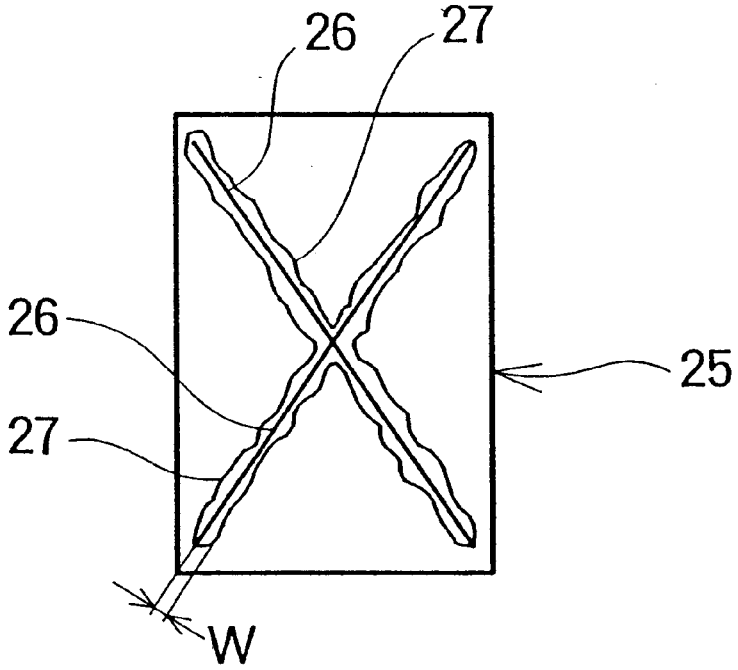

By visual inspection, or as shown in FIG. 5B. FIG. 5B shows corroded areas 27 as found on the test specimen 25 along the cut lines 26 after a salt spray test lasting for a specific length of time. The width W of each corroded area was measured on either side of the line 26, as shown in FIG. 5B.

Table 1 shows the chemical composition of the aluminum alloy material (JIS-ADC12) employed in these examples.

TABLE 1

| | Chemical composition (%) | | | | | | | | |
|---|---|---|---|---|---|---|---|---|---|
| Symbol | Cu | Si | Mg | Zn | Fe | Mn | Ni | Sn | Al |
| ADC12 | 1.5–3.5 | 9.6–120 | 3.0 or less | 1.0 or less | 1.3 or less | 0.5 or less | 0.5 or less | 0.3 or less | Balance |

Figure 6:
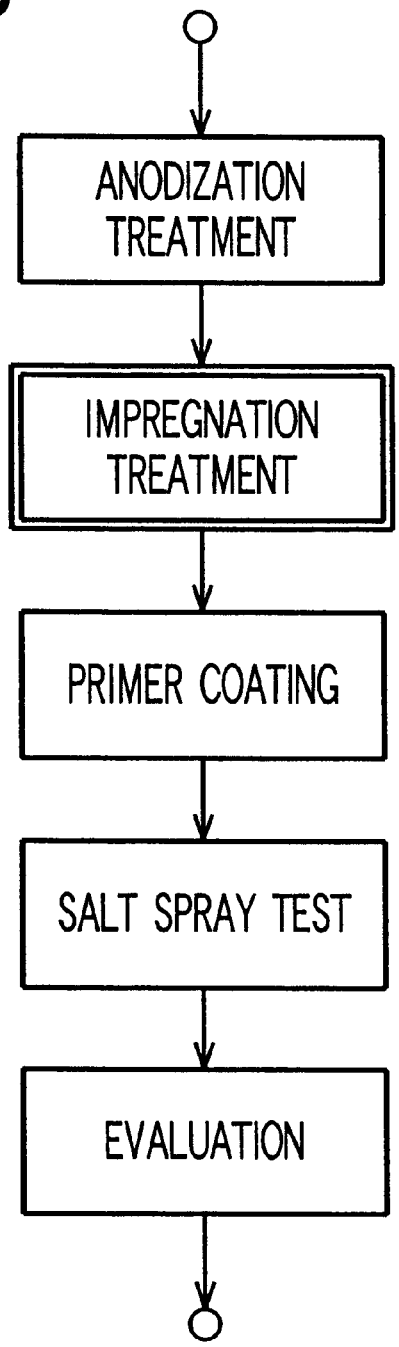
FIG. 6 is a flowchart showing the steps taken in Examples 1 to 3 and 4 to 8.
Figure 7:
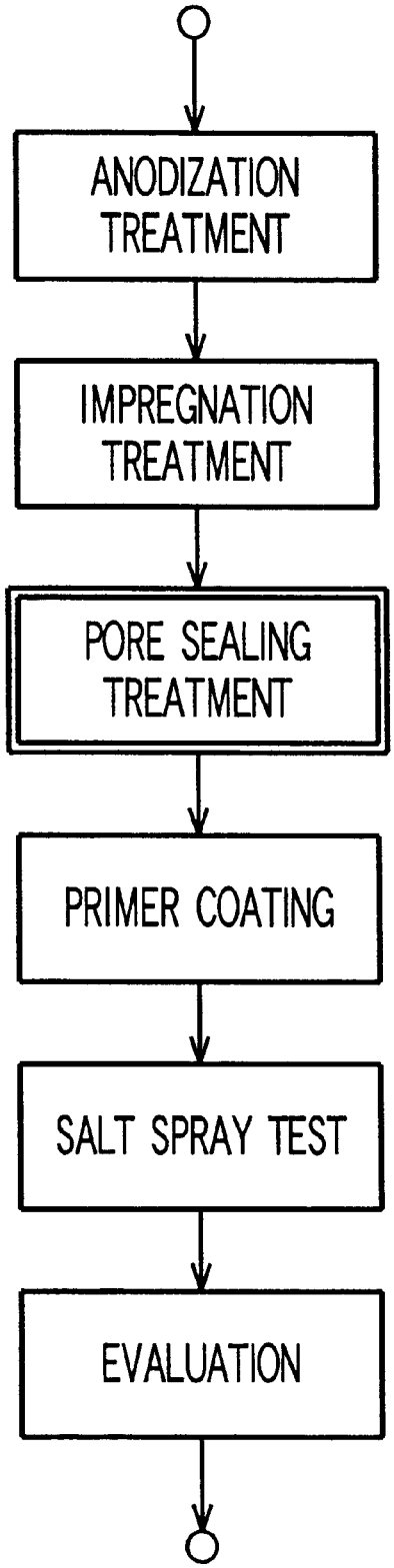
FIG. 7 is a flowchart showing the steps taken in Examples 9 to 12.
Figure 8:
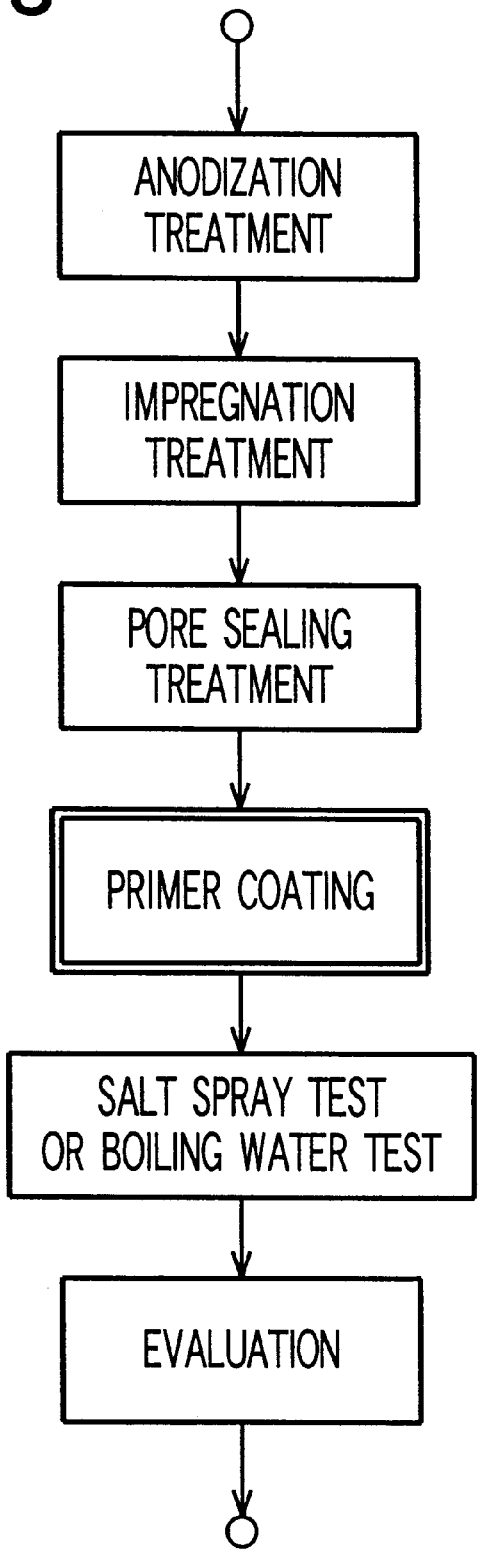
FIG. 8 is a flowchart showing the steps taken in Examples 13 to 15, 16 to 19 and 21 to 24.

FIGS. 6 to 8 show three flowcharts employed for conducting three groups of experiments concerning the invention, respectively, as will now be described.

EXAMPLES 1 TO 3 AND 4 TO 8

Each test specimen was prepared by anodizing the aluminum alloy material, impregnating the anodizing film to fill its pores and coating it with a primer, as shown in FIG. 6. Its salt spray test was conducted and the results thereof were evaluated. A different substance was employed from one experiment to another for impregnating the anodizing film, and was compared with another. More specifically, there were employed for comparison nickel acetate and zirconium phosphate as amorphous sealants, and zinc phosphate as a crystalline one.

TABLE 2

| Substance | | Example 1 Amorphous | Example 2 Amorphous | Example 3 Crystalline |
|---|---|---|---|---|
| Metallic material | | Aluminum alloy (JIS - ADC12 or equivalent) | | |
| Film | | Anodizing film (15 μm) | | |
| Impregnant | | Nickel acetate | Zirconium phosphate | Zinc phosphate |
| Primer | | Common epoxy paint (20 μm) | | |
| Salt spray test | | 500, 1000 and 2000 hours | | |
| Width of corroded area (mm) | 500 hours | Nearly zero | Nearly zero | 0.5–1.5 |
| | 1000 hours | 0.8–1.8 | 0.4–0.8 | 1.8–2.3 |
| | 2000 hours | 1.7–4.3 | 1.2–2.8 | 2.7–4.3 |
| Evaluation | | G | E | BL |

The results of Example 1, in which nickel acetate had been used as the impregnant, were evaluated as Good (G), since the corroded areas had a width of 1.7 to 4.3 mm after 2000 hours of test indicating a generally allowable degree of corrosion. The corrosion was apparently due to the fact that nickel acetate did not have the property of forming a layer of passivity with aluminum, though it was an amorphous substance. It was, however, found to be capable of sealing the inlets of pores in the anodizing film and restricting the progress of corrosion to some extent.

The results of Example 2, in which zirconium phosphate was used, were evaluated as Excellent (E), since the corroded areas had the minimum width in the range of 1.2 to 2.8 mm after 2000 hours.

The results of Example 3, in which zinc phosphate was used, were evaluated as Borderline (BL), since the corroded areas had a width of 2.7 to 4.3 mm after 2000 hours, as zinc phosphate was a crystalline substance not capable of forming a layer of passivity with aluminum.

As the results of Example 2 as shown in Table 2 indicated that zirconium phosphate was the best impregnant, all of the further experiments were made by employing zirconium phosphate.

TABLE 3

| | Example 4 | Example 5 | Example 6 | Example 7 | Example 8 |
|---|---|---|---|---|---|
| Metallic material | Aluminum alloy (JIS - ADC12 or equivalent) | | | | |
| Film | Anodizing film (15 μm) | | | | |
| Impregnant | Zirconium phosphate | | | | |
| Amount thereof | 3 mg/cm$^2$ | 5 mg/cm$^2$ | 15 mg/cm$^2$ | 45 mg/cm$^2$ | 60 mg/cm$^2$ |
| Primer | Common epoxy paint (20 μm) | | | | |
| *Width W (mm) | 2.8 | 1.8 | 1.2 | 1.5 | 2.4 |
| Evaluation | NG | BL | E | G | NG |

*Of corroded area found after 2000 hours of a salt spray test.

Every experiment shown in Table 3 was made by forming an anodizing film having a thickness of 15 microns on an aluminum alloy equivalent to ADC12 according to JIS, impregnating it with zirconium phosphate and coating it with a layer of a common epoxy paint having a thickness of 20 microns. The amount of zirconium phosphate was, however, varied from one example to another in the range of 3 to 60 mg/cm$^2$, so that an adequate amount thereof might be found. The result of Example 4 was evaluated as No Good (NG) since the corroded area had a width W of 2.8 mm. The result of Example 5 was evaluated as Borderline (BL) since the corroded area had a width W of 1.8 mm. The result of Example 6 was evaluated as Excellent (E), since the corroded area had a width W of as small as 1.2 mm. The result of Example 7 was evaluated as Good (G) since the corroded area had a width W of 1.5 mm. The result of Example 8 was evaluated as No Good (NG), since the corroded area had a width W of 2.4 mm. The result of Example 8 was apparently due to the fact that the amount of the impregnant were so large that it gathered between the anodizing film and the primer and caused the primer to be separated from the anodizing film. An adequate amount of the impregnant (zirconium phosphate) was, therefore, concluded as about 15 mg/cm$^2$ to 45 mg/cm$^2$ for an anodizing film having a thickness of 15 microns, and all of the further experiments were made by using that amount of zirconium phosphate.

EXAMPLES 9 TO 12

Each test specimen was prepared by anodizing the aluminum alloy material, impregnating the anodizing film to fill its pores, sealing the pores and coating it with a primer, as shown in FIG. 7. Its salt spray test was conducted and the results thereof were evaluated. These experiments were made for evaluating different kinds of sealants used for closing the pores.

TABLE 4

| | Example 9 | Example 10 | Example 11 | Example 12 |
|---|---|---|---|---|
| Metallic material | Aluminum alloy (JIS - ADC12 or equivalent) | | | |
| Film | Anodizing film (15 $\mu$m) | | | |
| Impregnant | Zirconium phosphate (15 mg/cm$^2$) | | | |
| Sealant | | Boiling pure water | Nickel acetate | Sodium silicate |
| Primer | Common epoxy paint (20 $\mu$m) | | | |
| *Width W (mm) | 1.2 | 0.8 | 0.5 | 0.8 |
| Evaluation | BL | G | E | G |

*Of corroded area found after 2000 hours of a salt spray test.

Every experiment shown in Table 4 was made by forming an anodizing film having a thickness of 15 microns on an aluminum alloy equivalent to ADC12 (JIS), impregnating it with zirconium phosphate in the amount of 15 mg/cm$^2$, applying a sealant to it and coating it with a layer of a common epoxy paint having a thickness of 20 microns. A different sealant was used from one example to another, so that an adequate substance might be selected.

The result of Example 9 was evaluated as Borderline (BL), since the corroded area had a width W of 1.2 mm as no sealing was made. The result of Example 10 was evaluated as Good (G), since the corroded area had a width W of 0.8 mm as reduced by sealing with boiling pure water. The result of Example 11 was evaluated as Excellent (E), since the corroded area had a width W of 0.5 mm as reduced by sealing with nickel acetate. The result of Example 12 was evaluated as Good (G), since the corroded area had a width W of 0.8 mm after sealing with sodium silicate.

As the results shown in Table 4 indicated that nickel acetate was an adequate sealant, all of the further experiments were made by employing nickel acetate for sealing the pores.

EXAMPLES 13 TO 15, 16 TO 19 AND 20 TO 24

Each test specimen was prepared by anodizing the aluminum alloy material, impregnating the anodizing film to fill its pores, sealing the pores and coating it with a primer, as shown in FIG. 8. Its salt spray test was conducted and the results thereof were evaluated. These experiments were made for evaluating different kinds of primers.

TABLE 5

| | Example 13 | Example 14 | Example 15 |
|---|---|---|---|
| Metallic material | Aluminum alloy (JIS - ADC12 or equivalent) | | |
| Film | Anodizing film (15 $\mu$m) | | |
| Impregnant | Zirconium phosphate (15 mg/cm$^2$) | | |
| Sealant | Nickel acetate (20 min.) | | |
| Primer | Zinc phosphate | Phosphomolybdic acid | Tripolyphosphoric acid |
| Evaluation* | BL | G | BL |

*After 2000 hours of a salt spray test.

Every experiment shown in Table 5 was made by forming an anodizing film having a thickness of 15 microns on an aluminum alloy equivalent to ADC12 (JIS), impregnating it with zirconium phosphate in the amount of 15 mg/cm$^2$, subjecting it to 20 minutes of sealing treatment with nickel acetate and coating it with a layer of a common epoxy paint. A different primer containing a different pigment was used from one example to another, so that an adequate substance might be selected. Although no width of any corroded area is shown, the evaluation for each example was based on the result of 2000 hours of a salt spray test.

The result of Example 13, in which zinc phosphate was used as a pigment in an epoxy resin primer, was evaluated as Borderline (BL), since some corrosion was found. It appears that zinc phosphate can make only a weak bond with an anodizing film. The result of Example 14, in which phosphomolybdic acid was used as a pigment in an epoxy resin primer, was evaluated as Good (G), since only a small degree of corrosion was found. It appears that phosphomolybdic acid can make a strong bond with an anodizing film. The result of Example 15, in which tripolyphosphoric acid was used as a pigment in an epoxy resin primer, was evaluated as Borderline (BL), since some corrosion was found. It appears that tripolyphosphoric acid can make only a weak bond with an anodizing film.

The results shown in Table 5 indicated that phosphomolybdic acid was preferred as a pigment for a primer. Further experiments were, therefore, made to determine the adequate amount of phosphomolybdic acid.

TABLE 6

| | Example 16 | Example 17 | Example 18 | Example 19 |
|---|---|---|---|---|
| Metallic material | Aluminum alloy (JIS - ADC12 or equivalent) | | | |
| Film | Anodizing film (15 $\mu$m) | | | |
| Impregnant | Zirconium phosphate (15 mg/cm$^2$) | | | |
| Sealant | Nickel acetate (20 min.) | | | |
| Primer | Proportion of phosphomolybdic acid as a pigment (wt. %) | | | |
| | 0% | 5% | 15% | 20% |
| *Width W (mm) | 2.1 | 0.3 | 0.1 | 0.8 |
| Evaluation | NG | G | G | NG |

*Of corroded area found after 2000 hours of a salt spray test.

Every experiment shown in Table 6 was made by forming an anodizing film having a thickness of 15 microns on an aluminum alloy equivalent to ADC12 (JIS), impregnating it with zirconium phosphate in the amount of 15 mg/cm$^2$, subjecting it to 20 minutes of sealing treatment with nickel acetate and coating it with a layer of a common epoxy paint containing phosphomolybdic acid as a pigment. The evaluation was based on the results of a salt spray test.

The result of Example 16 was evaluated as No Good (NG), since the primer did not contain any pigment. The result of Example 17, in which the primer had a pigment proportion of 5% by weight, was evaluated as Good (G), since the corroded area had a width reduced to 0.3 mm. The result of Example 18, in which the primer had a pigment proportion of 15% by weight, was also evaluated as Good (G), since the corroded area had a width of as small as 0.1 mm. The result of Example 19, in which the primer had a pigment proportion of 20% by weight, was evaluated as No Good (NG), since the corroded area had a width of as large as 0.8 mm. Thus, it is obviously preferable to employ phosphomolybdic acid as a pigment in the amount of 5 to 15% by weight.

TABLE 7

| | Example 20 | Example 21 | Example 22 | Example 23 | Example 24 |
|---|---|---|---|---|---|
| Metallic material | Aluminum alloy (JIS - ADC12 or equivalent) | | | | |
| Film | Anodizing film (15 $\mu$m) | | | | |
| Impregnant | Zirconium phosphate (15 mg/cm$^2$) | | | | |
| Sealant | Nickel acetate (20 min) | | | | |
| Primer | Epoxy resin proportion (wt %) | | | | |
| | 20% | 30% | 40% | 60% | 70% |
| Evaluation | NG | NG | G | G | NG |

*Based on the result of a boiling water test.

Every experiment shown in Table 7 was made by forming an anodizing film having a thickness of 15 microns on an aluminum alloy equivalent to ADC12 (JIS), impregnating it with zirconium phosphate in the amount of 15 mg/cm$^2$, subjecting it to 20 minutes of sealing treatment with nickel acetate and coating it with a layer of a common epoxy paint containing 10% by weight of phosphomolybdic acid. The primer had a different epoxy resin proportion from one example to another. The evaluation was based on the result of a boiling water test conducted by cutting a checkered pattern of 1 mm square notches in each test specimen with a knife and leaving it to stand in boiling water for eight hours.

The result of Example 20, in which the primer had an epoxy resin proportion of 20% by weight, was evaluated as No Good (NG), since the boiling water test resulted in a blister giving a poor outward appearance. The result of Example 21, in which the primer had an epoxy resin proportion of 30% by weight, was also evaluated as No Good (NG), since the boiling water test resulted in a blister giving a poor outward appearance. The result of Example 22, in which the primer had an epoxy resin proportion of 40% by weight, was evaluated as Good (G), since the boiling water test did not result in any blister, but allowed the test specimen to maintain a good appearance. The result of Example 23, in which the primer had an epoxy resin proportion of 60% by weight, was also evaluated as Good (G), since the boiling water test did not result in any blister, but allowed the test specimen to maintain a good appearance. The result of Example 24, in which the primer had an epoxy resin proportion of 70% by weight, was evaluated as No Good (NG), since the boiling water test resulted in a blister giving the test specimen a poor appearance.

The results of the experiments involving an epoxy resin proportion of less than 40% by weight were apparently due to the fact that the primer layer could not shut off water effectively, but allowed water to collect therein and lower its water blister resistance and its adhesive strength. If the epoxy resin proportion exceeded 60% by weight, it was difficult to form a sound primer coating. There was apparently formed a defective coating as a result of its cohesive failure due to its low resistance to any impact from an external source, and its water resistance (i.e. blister resistance and adhesive strength) lowered by the damage given to the resin by burrs, cracks, or like defects that had occurred during molding. Thus, it is adequate to select an epoxy resin proportion of 40 to 60% by weight for the primer.

Although ADC12 (JIS) was employed as the aluminum alloy material for the experiments, this invention is equally applicable to any die casting of aluminum, such as ADC3 (JIS), or any other aluminum alloy.

The present disclosure relates to the subject matter of Japanese Patent Application No. 2001-057868, filed Mar. 2, 2001, the disclosure of which is incorporated herein by reference in its entirety,

What is claimed is:

1. A process for improving an anodic oxide film, comprising the steps of:

forming an anodic oxide film on a surface of an aluminum alloy material, the anodic oxide film having pores formed therein during its growth;

filling the pores of the anodic oxide film with an amorphous substance, the amorphous substance being capable of forming, together with aluminum, a passivation layer on the surface of the aluminum alloy material; and sealing the pores to close inlets thereof to confine the amorphous substance within the pores.

2. A process for improving an anodic oxide film according to claim 1; wherein the amorphous substance is amorphous zirconium phosphate.

3. A process for improving an anodic oxide film according to claim 2; wherein the step of filling the pores of the anodic oxide film comprises the step of impregnating the amorphous zirconium phosphate into the anodic oxide film in an amount within the range of 15 mg/cm$^2$ to 45 mg/cm$^2$.

4. A process for improving an anodic oxide film according to claim 1; wherein the step of sealing the pores is performed by forming a film using nickel acetate over the anodic oxide film.

5. A process for improving an anodic oxide film according to claim 1; further comprising the step of coating the surface of the anodic oxide film with a primer after performing the step of sealing the pores.

6. A process for improving an anodic oxide film according to claim 5; wherein the primer contains phosphomolybdic acid as a pigment.

7. A process for improving an anodic oxide film according to claim 6; wherein the phosphomolybdic acid is contained in a proportion of 5 to 15% by weight of the primer.

8. An anodic oxide film structure comprising:

an anodic oxide film formed on a surface of an aluminum alloy material, the anodic oxide film having pores formed therein during its growth;

amorphous zirconium phosphate filled in the pores of the anodic oxide film, the amorphous zirconium phosphate being capable of forming, together with aluminum, a passivation layer over the surface of the aluminum alloy material; and a sealant layer for sealing inlets of the pores to confine the amorphous zirconium phosphate within the pores.

9. An anodic oxide film structure according to claim 8; wherein the amorphous zirconium phosphate is included in the amount of 15 mg/cm$^2$ to 45 mg/cm$^2$.

10. An anodic oxide film structure according to claim 8; further comprising a primer layer formed over the sealant layer.

11. An anodic oxide film structure according to claim 10; wherein the primer layer is formed from a primer containing phosphomolybdic acid as a pigment.

12. An aluminum alloy outboard engine comprising:

an engine cover;

an under cover attached to the bottom of the engine cover;

an extension case attached to the bottom of the under cover;

a gear case attached to the bottom of the extension case; and an anodic oxide film structure formed on at least the extension and gear cases and comprising an anodic oxide film formed on a surface of an aluminum alloy material, the anodic oxide film having pores formed therein during its growth, amorphous zirconium phosphate filled in the pores of the anodic oxide film, the amorphous zirconium phosphate being capable of forming, together with aluminum, a passivation layer over the surface of the aluminum alloy material, and a sealant layer for closing inlets of the pores to confine the amorphous zirconium phosphate within the pores.

13. An aluminum alloy outboard engine according to claim 12; wherein the amorphous zirconium phosphate is included in the amount of 15 $mg/cm^2$ to 45 $mg/cm^2$.

14. An aluminum alloy outboard engine according to claim 12; wherein the anodic oxide film structure further comprises a primer layer formed over the sealant layer.

15. An aluminum alloy outboard engine according to claim 14; wherein the primer layer is formed from a primer containing phosphomolybdic acid as a pigment.

16. An anodized aluminum alloy product comprising:

an aluminum alloy body; an anodic oxide film formed on a surface of the aluminum alloy body and having pores formed therein during its growth; an amorphous substance filled in the pores of the anodic oxide film, the amorphous substance being a material capable of forming, together with aluminum, a passivation film over the surface of the aluminum alloy body; and a sealant layer for closing inlets of the pores to confine the amorphous substance within the pores; whereby if the anodic oxide film becomes exposed, the amorphous substance confined in the pores reacts with an exposed part of the aluminum alloy to form a passivation layer at the exposed part of the aluminum alloy.

17. An anodized aluminum alloy product according to claim 16; wherein the amorphous substance is amorphous zirconium phosphate.

18. An anodized aluminum alloy product according to claim 17; wherein the amorphous zirconium phosphate is included in an amount within the range of 15 $mg/cm^2$ to 45 $mg/cm^2$.

19. An anodized aluminum alloy product according to claim 16; wherein the sealant layer comprises nickel acetate.

20. An anodized aluminum alloy product according to claim 16; further comprising a primer layer formed on the sealant layer.

21. An anodized aluminum alloy product according to claim 20; wherein the primer layer is formed from a primer containing phosphomolybdic acid as a pigment.

* * * * *